United States Patent [19]

Barthelmess

[11] 4,390,419

[45] Jun. 28, 1983

[54] CENTRIFUGAL CLASSIFIER

[75] Inventor: Ulrich Barthelmess, Niederstotzingen, Fed. Rep. of Germany

[73] Assignee: OMYA GmbH, Cologne, Fed. Rep. of Germany

[21] Appl. No.: 312,027

[22] Filed: Oct. 16, 1981

[51] Int. Cl.[3] ..... B07B 7/083

[52] U.S. Cl. ..... 209/11; 209/144

[58] Field of Search ..... 209/11, 144, 145, 139 A, 209/139 R

[56] References Cited

U.S. PATENT DOCUMENTS

| | | | |
|---|---|---|---|
| 3,384,238 | 5/1968 | Alpha | 209/144 X |
| 3,901,794 | 8/1975 | Henne et al. | 209/11 |
| 4,296,864 | 10/1981 | Misaka et al. | 209/144 |

FOREIGN PATENT DOCUMENTS

| | | | |
|---|---|---|---|
| 580847 | 7/1933 | Fed. Rep. of Germany | 209/144 |
| 1918573 | 10/1970 | Fed. Rep. of Germany | 209/11 |

*Primary Examiner*—Ralph J. Hill

*Attorney, Agent, or Firm*—Pollock, Vande Sande & Priddy

[57] ABSTRACT

A centrifugal classifier is disclosed which has a higher throughput than existing classifiers. The classifier has a substantially cylindrical upright housing with an approximately tangential sifting-air inlet in which are arranged at a radial distance from, and centrally of, the casing of the housing, a vane-ring and, at a radial distance inwardly therefrom, a sifting rotor with a lamination-ring forming radial passages, an inlet for the granular material to be classified opening, at the top, into the classifying area located between the vane-ring and sifting rotor, and an outlet for the sifting air, charged with fine material, being located adjacent the rotor, the diameter of the outlet corresponding approximately to the inside diameter of the rotor, and the sifting-air inlet and the vane-ring extending over approximately the same axial length as the rotor, characterized in that the two end-faces of the sifting rotor are each located adjacent a fine-material/sifting-air outlet.

7 Claims, 3 Drawing Figures

CENTRIFUGAL CLASSIFIER

TECHNICAL FIELD

The invention relates to a centrifugal classifier.

BACKGROUND ART

A classifier of this kind, as already known from German OS No. 1,607,631, is used for classifying, i.e. separating a mixture or quantity of granular material, of different sizes and/or different shapes and/or different specific weight, into coarse material or coarse grains (of a grain-size above a certain diameter) and fine material (of a grain-size below that limit). The material to be classified is charged from above into a classifying area (an annular space between a vane-ring and a sifting rotor); at the same time, sifting air flows from the outside, through the vane-ring, into the classifying area, thus following a spiral path and carrying the particles along accordingly. In the classifying area, the particles are subjected to radially directed resistance and centrifugal forces acting in opposite directions. For a specific radial and axial air-velocity, there exists a limiting grain size at which the two forces are equal.

The coarser particles (coarser than the limiting size) thus arrive sooner or later at the coarse-material outlet at the bottom of the classifying area. The fine material, on the other hand, is carried along with the sifting air which flows inwardly through the passages in the sifting wheel and is drawn off through a fine-material/sifting-air outlet adjoining axially the interior of the sifting wheel. The fine material is finally separated from, or precipitated out of, the sifting air which can then be returned to the sifting-air inlet, i.e. it can be circulated. Classifiers of this kind are used mainly for recovering fine material of the smallest possible grain-size and in a narrow grain-size distribution, the upper limit sought being between 2 and 4 μm This very fine granular material is frequently used as a filler, for synthetic material, automobile tires, colours, paints or coating agents for paper. The coarse material is used for other purposes, or is reground to yield further fine material.

Relatively large quantities are required for the above-mentioned purposes at the lowest possible price. With existing classifiers of this kind, however, comprising only one fine-material/sifting-air outlet, the throughput is relatively low, being dependent upon, among other things, the dimensions of the classifier, more particularly the length and diameter of the sifting rotor, i.e. the peripheral surface thereof where classifying takes place. Diameter is limited by increasing centrifugal force, while the limiting grain size is dependent upon diameter and r.p.m., and thus also upon centrifugal force. The length of the sifting rotor is also limited, mainly because of the difference in radial flow-velocity along the sifting rotor between pairs of laminations. This radial flow-velocity is dependent upon the suction, i.e. negative pressure applied at the outlet, the said suction being at its maximum at the outlet and decreasing towards the opposite end.

DISCLOSURE OF THE INVENTION

It is the purpose of the invention to provide a classifier of this kind with far higher throughput, preferable for grain sizes from 10 down to 2 μm. According to the invention, this purpose is achieved by locating a fine-material/sifting-air outlet at each end-face of the sifting rotor.

These two fine-material/sifting-air outlets make it possible to use a much longer sifting rotor than heretofore, resulting in a correspondingly higher throughput. The great length of the sifting rotor provides a corresponding zone of relatively uniform stable flow undisturbed by irregularities at the ends of the sifting rotor, thus achieving correspondingly effective and uniform classifying. The diameter:length ratio of the sifting rotor is preferably between 1:1.5 and 1:4.

The two fine-material/sifting-air outlets almost double the cross-section of the outlet, so that in spite of the increased throughput, the flow-velocity is lower. With the high flow-velocities hitherto used, the fine material strikes the walls so violently that it adheres thereto, especially if an initial coating of fine material has already been deposited thereon. This progressively impairs the flow conditions and results in a decrease in throughput.

Above all, however, some of these stratified deposited (so-called "eggshells") burst and pass into the fine material which leads to major difficulties or even renders the fine material useless. In order to avoid these deposits, therefore, the flow rate has been limited, but this also limits the throughput.

According to the invention, these deposits of fine material are prevented by surrounding the two fine-material/sifting-air outlets, in the vicinity or the rotor, with cooling chambers, since cooler particles adhere less easily to a cooled surface. In this connection, it is desirable to arrange the bearings at each end of the sifting-rotor shaft in the cooling chambers. This also cools the bearings, thus increasing the reliability and life of the machine. With increased throughput, this becomes particularly important.

According to another configuration, a labyrinth-seal is provided at each end-face of the sifting rotor, each of the said seals communicating through a duct with one of the cooling chambers. The cooling air thus also serves to flush the labyrinth-seals from outside to inside. This not only cools the said seals, but also eliminates the need for a separate source of flushing air. A flushed labyrinth-seal in a classifier is already known from German AS No. 1,757,582.

According to still another configuration, support-discs, provided with axial passages, for retaining the sifting-rotor laminations, are shrunk onto the shaft. The rotor laminations are thus secured, not only at their ends, but also by the said support-discs between the ends.

Finally, an annular duct for injecting into the classifying area the amount of material to be classified is provided at the end-face of the housing facing the coarse-material outlet. This permits uniform charging of the increased throughput.

BRIEF DESCRIPTION OF THE DRAWINGS

A better explanation is provided by the following description of an example of embodiment of the invention, in conjunction with the drawing attached hereto, wherein.

BEST MODE FOR CARRYING OUT THE INVENTION

Figure 1:
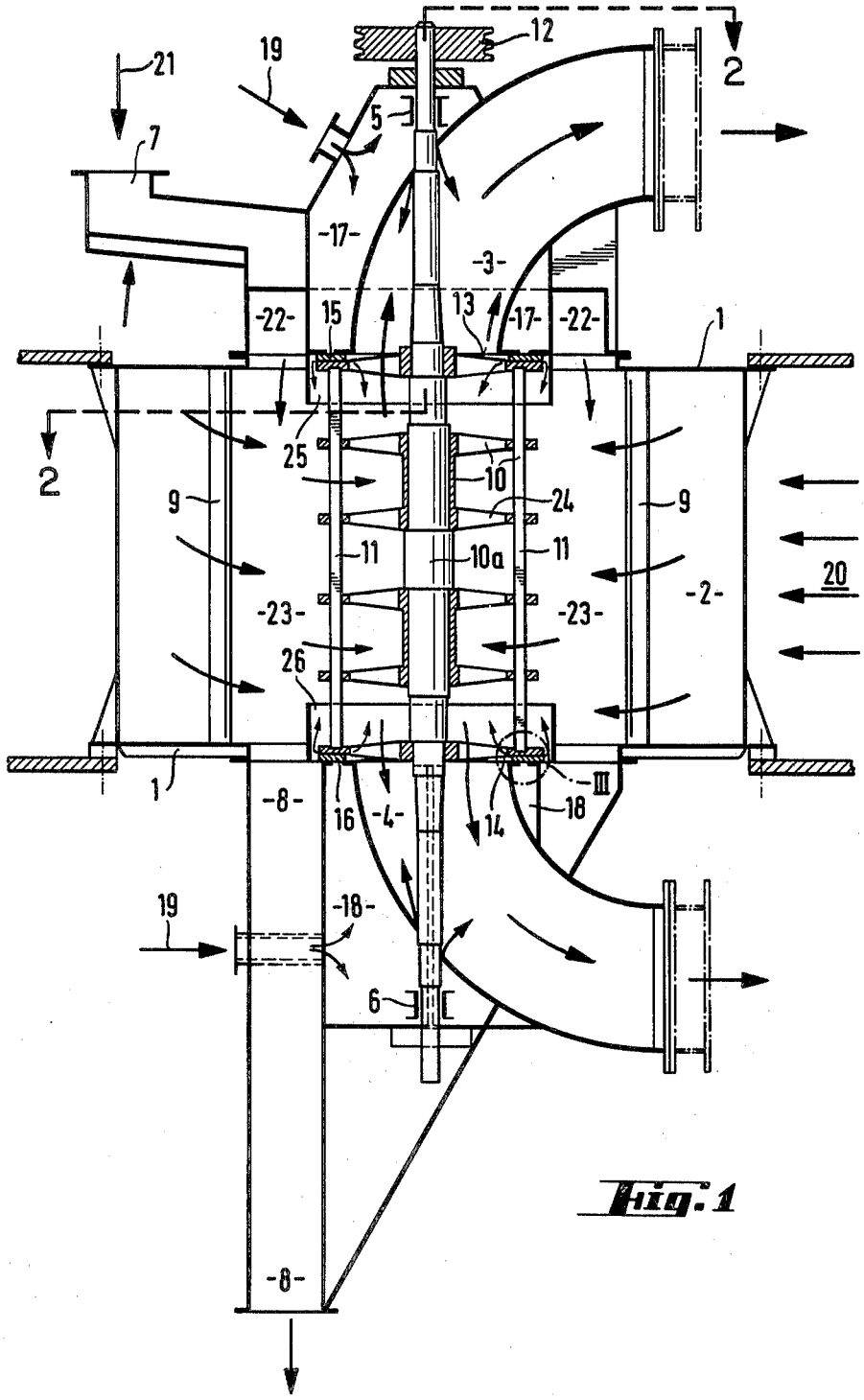
FIG. 1 is a longitudinal section through a classifier according to the invention.
Figure 2:
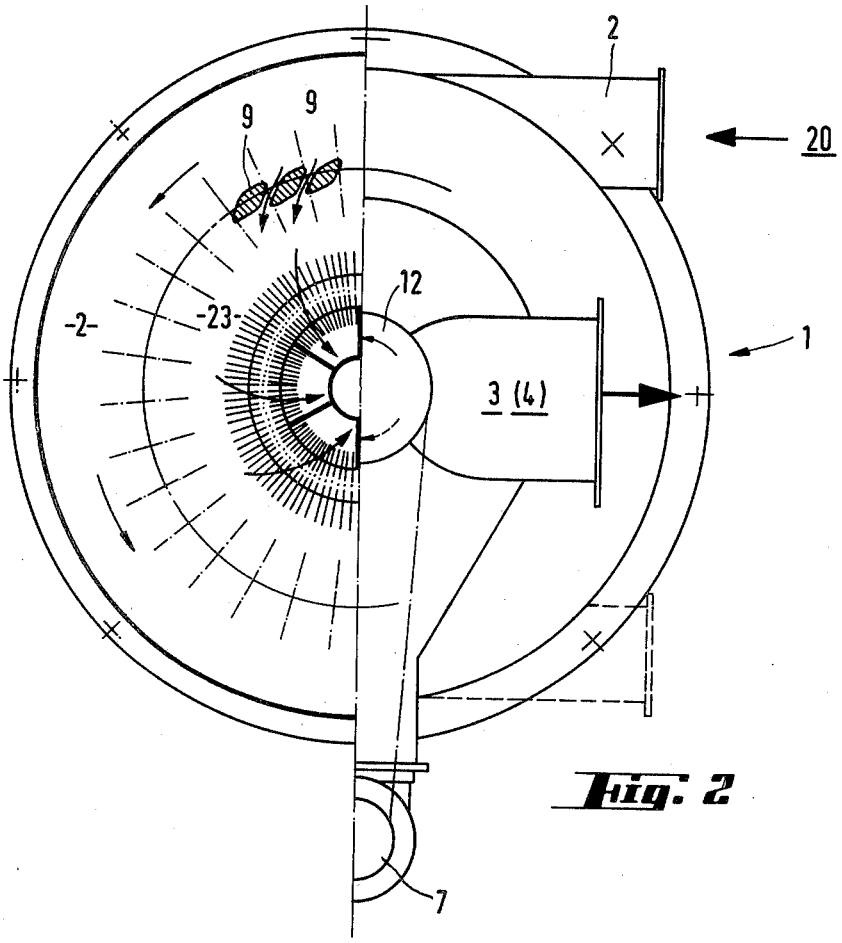
FIG. 2 is a view of the classifier from above, to the left in cross-section and to the right in plan-view.

The classifier comprises a concentric, substantially cylindrical housing 1 with a tangential sifting-air inlet 2, into which the sifting air enters, uniformly over the entire axial height, in the direction of arrows 20.

A vane-ring 9 is arranged in the said housing, spaced radially from the casing thereof. Lamination-ring 11 on the sifting or classifying rotor is also spaced radially from the vane-ring 9. The granular material to be separated is charged from above into classifying area 23 between vane-ring 9 and rotor lamination-ring 11. An annular duct 22, for injecting the granular material, is provided in the upper part of the housing wall, with a connector 7 opening into the said duct. Located at the opposite, i.e. the lower, end-face of the housing is a funnel-shaped coarse-material outlet 8.

Located at each end-face of the sifting rotor is a fine-material/sifting-air outlet 3, 4 in the form of a curved piece of pipe, the diameter of which corresponds approximately to the inside diameter of the rotor.

Sifting-air/fine-material outlets 3, 4 are each surrounded by a cooling-air chamber 17, 18 to each of which cooling air is supplied through a connection 19 which prevents fine material from being deposited in the said outlets. Also mounted in cooling-air chambers 17, 18, at both ends, in bearing brackets 5, 6, is the rotor-shaft 10*a* which passes through curved outlets 3, 4. The bearings are thus also cooled. Due to the positive pressure obtaining in the said cooling-air chambers, no fine material can enter them (see arrows in shaft lead-throughs). Drive is by a V/belt pulley 12.

Figure 3:
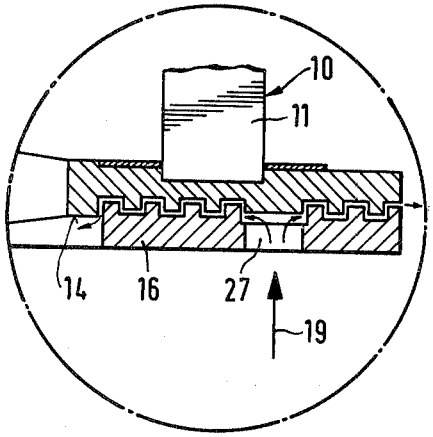
FIG. 3 is an enlarged view of detail III in FIG. 1, namely of the labyrinth-seal with a supply of flushing air from the cooling chamber.

Sifting rotor 10 is open at both end-faces in such a manner that it is sealed to outlets 3, 4. Located between the sifting rotor and the housing is a seal 15, 16 in the form of a flat disc or a labyrinth. Flushing air is introduced from cooling-air chambers 17, 18, through a duct 27, to provide a seal between sifting area 23 and outlets 3, 4 (arrow 19 in FIG. 3).

Support-discs 24, equipped with radially extending passages, are shrunk onto shaft 10*a* of the sifting rotor. Thus, as shown in FIG. 1, the interior chamber of the rotor is open along its axial length to a flow of air and fine granular material passing from said radial passages toward both ends of said interior volume. The outer periphery of each end of the rotor is surrounded by a deflector ring 25, 26.

The embodiments of the invention in which an exclusive property or privilege is claimed are defined as follows:

1. An improved centrifugal classifier, comprising:

a substantially cylindrical housing having an approximately tangential inlet for classifying air;

a vane ring arranged centrally within said housing and spaced radially inwardly from the casing thereof, said vane ring being of approximately the same axial length as said inlet for classifying air;

a classifying rotor arranged for rotation within and spaced radially inwardly from said vane ring, said rotor also being of approximately the same axial length as said inlet for classifying air and comprising a circumferentially and axially extending lamination ring defining radially extending passages leading from the outside diameter of said rotor to an axially extending interior volume in said rotor, said interior volume being open along its axial length to flow of air and fine granular material passing from said radial passages toward both ends of said interior volume and defining an inside diameter for said rotor;

an inlet for granular material to be classified, said inlet opening into a classifying area located between said vane ring and said lamination ring;

a first outlet for coarse granular material and air, said first outlet opening from said classifying area; and second and third outlets for fine granular material and air, said second outlet being located at one end of said interior volume and said third outlet being located at the other end of said interior volume, the diameters of said second and third outlets corresponding approximately to said inside diameter of said rotor.

2. The classifier according to claim 1, wherein the diameter-to-length ratio of said rotor is between 1:1.5 and 1:4.0.

3. The classifier according to claim 1, wherein each of said second and third outlets is surrounded, in the vicinity of said rotor, by a cooling-air chamber.

4. The classifier according to claim 3, wherein said rotor comprises a shaft mounted in bearings at both ends, the bearings at each end being arranged in one of said cooling-air chambers.

5. The classifier according to claim 4, further comprising a labyrinth-seal provided at each end-face of said rotor, each seal communicating, through a duct, with one of said cooling-air chambers.

6. The classifier according to claim 5, wherein support discs equipped with axial passages are shrunk onto said shaft for retaining the laminations of said rotor.

7. The classifier according to claim 1, 4 or 6, wherein an annular duct is provided for injecting the material to be classified into said classifying area at the end-face of said housing facing said first outlet.

* * * * *